United States Patent [19]

Kendall

[11] 3,986,647

[45] Oct. 19, 1976

[54] PLEAT SEWING GUIDE

[76] Inventor: Svava Kendall, 2853 Tulare Ave., Richmond, Calif. 94804

[22] Filed: Mar. 7, 1975

[21] Appl. No.: 556,211

[52] U.S. Cl. ..... 223/38; 112/146; 112/120

[51] Int. Cl.[2] ..... A41H 33/00; D05B 35/08

[58] Field of Search ..... 112/146, 136, 144, 145, 112/153, 120; 223/35, 38

[56] References Cited

UNITED STATES PATENTS

| | | | |
|---|---|---|---|
| 309,023 | 12/1884 | Bouillon | 112/146 |
| 3,430,591 | 3/1969 | Kendall | 112/146 |

FOREIGN PATENTS OR APPLICATIONS

| | | | |
|---|---|---|---|
| 338,922 | 7/1921 | Germany | 223/35 |

*Primary Examiner*—Werner H. Schroeder
*Assistant Examiner*—Peter Nerbun
*Attorney, Agent, or Firm*—George B. White

[57] ABSTRACT

In this pleat sewing guide there is a flat sewing guide leg at one end of which is an elongated transverse head in which latter is a longitudinal channel from which extend threaded guide pins spaced on opposite sides of the sewing guide leg; a pair of adjustable legs are spaced on the opposite sides of the fixed guide leg; one of the adjustable legs is adjusted to indicate the depth of the pleat and the other leg is adapted to engage the next preceding pleat to determine the spacing of the pleat; the improvements on this pleat sewing guide are the provision of aligning shoulders or abutments on all the legs which are in a line parallel with the cross head so that the material is always aligned so that the edge of the material is always in perfectly parallel alignment with the cross head; and further the cross head has flanges extended to the same distance as the distance of the shoulders on the respective adjustable legs from the edge of the cross head; and further there are a pair of cutaway recesses one on each side of the sewing guide leg to positively receive and locate the presser foot on either side of the sewing guide leg for the sewing of the seam.

2 Claims, 8 Drawing Figures

PLEAT SEWING GUIDE

BACKGROUND OF THE INVENTION

The adjustable sewing guide for draperies or drapery pleater herein is an improvement of U.S. Pat. No. 3,430,591 issued on Mar. 4, 1969, and applicant is aware of all the references cited in said patent. An object of the invention is to provide positive guidance for the presser foot of the sewing machine on both sides of the fixed guide, thereby to permit a positive forming of two seams spaced from one another to form a pocket without the need of a second adjustment on the device or shifting the material. Further object of the invention is to provide for positive alignment of the edge of the material so as to assure accurate spacing and straight parallel seams.

DETAILED DESCRIPTION

Figure 1:
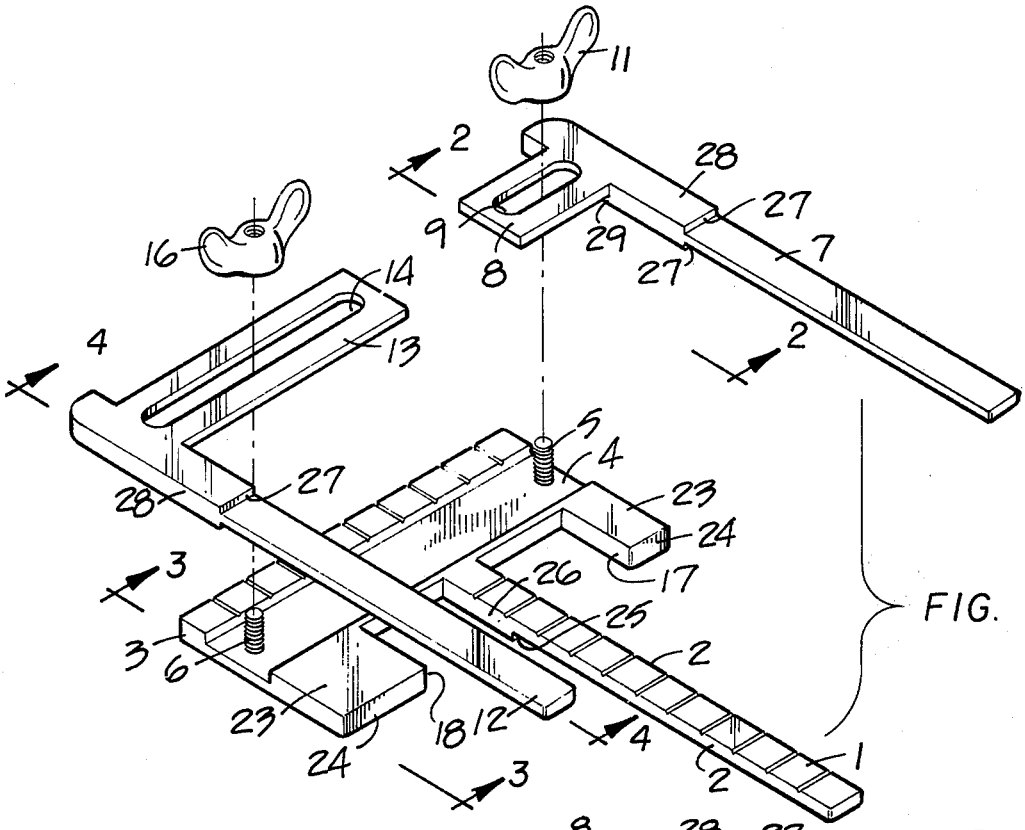
FIG. 1 is a perspective developed view of the pleat sewing guide.
Figure 2:
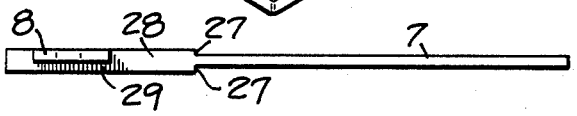
FIG. 2 is a view of one of the adjustable legs viewing in the direction of arrows 2—2 on FIG. 1.
Figure 3:
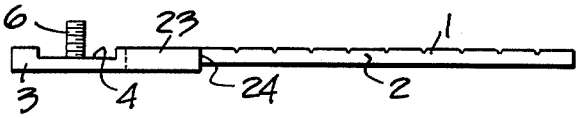
FIG. 3 is the side view of the fixed leg and the cross-head, viewing in the direction of the arrows 3—3 of FIG. 1.
Figure 4:
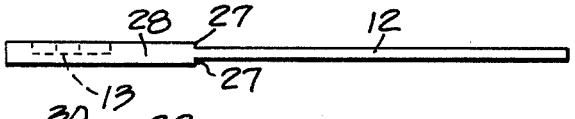
FIG. 4 is a side view of the spacing adjusting leg viewing in the direction of arrows 4—4 of FIG. 1.
Figure 5:
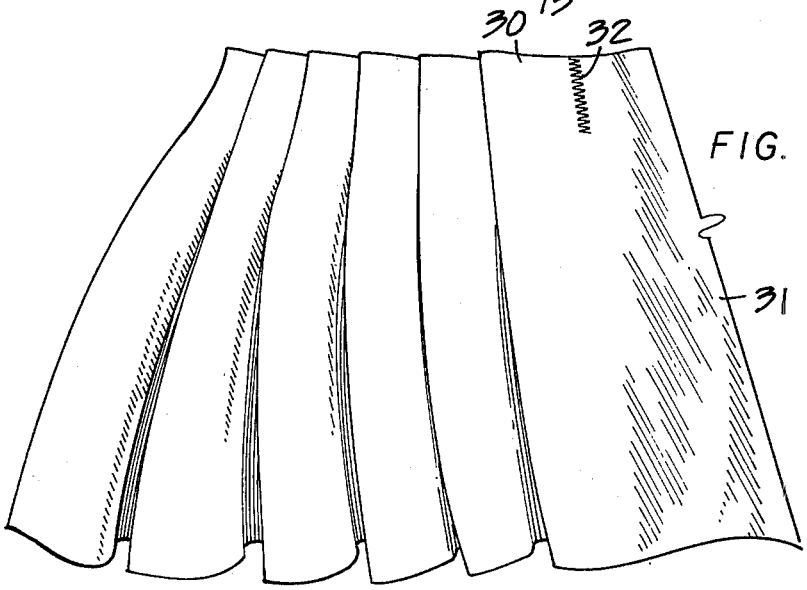
FIG. 5 is an example of the even pleating accomplished by the sewing guide with a single seam.

The drapery pleater and sewing guide herein is an improvement on the aforesaid patent, and it includes the elements of a fixed sewing guide leg 1, which is flat with straight guide edges 2 along the opposite sides of the leg 1. A cross head 3 is on one end of the sewing guide 1. This cross head 3 is also flat and it is at right angles to the sewing guide 1. On the cross head 3 is a longitudinal channel 4. Threaded guide pins 5 and 6 extend from the channel 4 spaced in opposite directions from the fixed sewing guide leg 1. An adjustable leg 7 hereinafter referred to as the depth measuring leg 7 has a transverse head 8 slidably fitting in one end of the channel 4. The head 8 has a slot 9 in it which rides on the adjacent guide pin 5. A wing nut 11 is adapted to be tightened on the threaded guide pin 5 for loosening or tightening at will the depth measuring leg 7 in adjusted position. Another leg, hereinafter referred to as pleat spacer leg 12 has a transverse head 13 at an end thereof which has an elongated slot 14 thereof slidable over the adjacent guide pin 6 and can be secured in place or loosened as the case may be by a suitable wing nut 16.

One of the improvements on the above structure include a flange integrally extended from the cross head toward the fixed leg 1 and it is cut way on opposite sides of the fixed leg 1 to form a pocket 17 and 18 at the respective edge 2. Each pocket 17 and 18 is of a size to accommodate a presser foot 19 of a sewing machine. The cut away flange is of the same thickness as the cross head 3 and in effect forms flat lugs 23 at opposite ends of the cross head 3, with aligning edges 24. The sewing guide leg 1 has an aligning shoulder 25 on its lower face. This shoulder 25 is formed by making the leg 1 thinner up to the shoulder 25 and forming a hub 26 thereon between the base of the pockets 17 and 18 and the shoulder 25. This shoulder 25 is in alignment with the edges 24 of the lugs 23.

Another improvement is that each adjustable leg has thereon aligning shoulders 27 both on the top and bottom faces. These shoulders 27 are formed by making the adjustable legs 7 and 12 thinner than the thickness of their respective hubs 28. The transverse heads 8 and 13 are also formed with a shoulder 29 along the hub 28 so that the heads 8 and 13 slidably fit into the channel 4 but the shoulder 29 abut against the respective ends of the cross head 3. However, the top surface of the hub 28 and the respective heads 8 and 13 are level with the top of the cross head 3.

Figure 6:
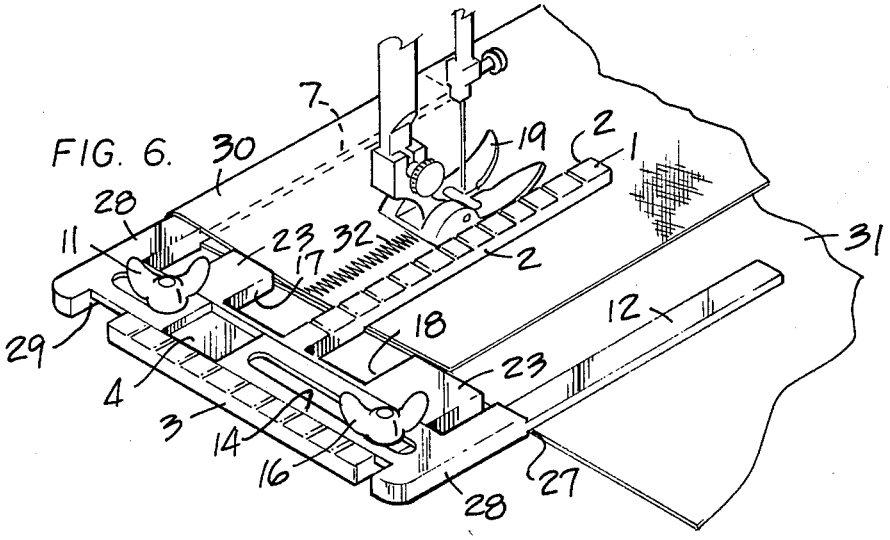
FIG. 6 is an illustration of forming the first pleat with a single seam.
Figure 7:
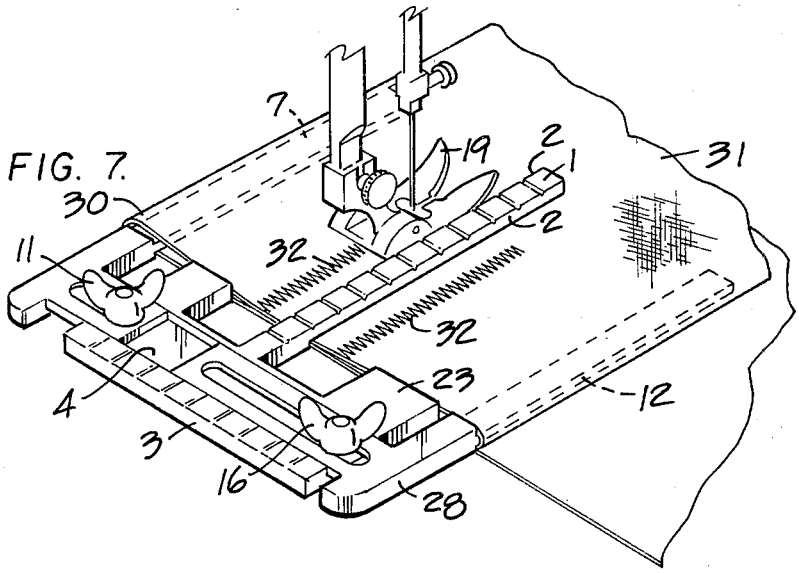
FIG. 7 is an illustration of the forming of the second pleat.

The herein improvements proved very important in making pleats. The basic operation of this pleat sewing guide is the same as in the previous U.S. Pat. No. 3,430,591 so far as the forming of the first pleat is concerned. Namely, to make the first pleat, the fabric is placed on the sewing machine right side up, and viewing on FIG. 6, 7, and 8 the person operating the sewing machine would be located at the top of said figures looking toward the presser foot 19 of the sewing machine so that the heading 30 of the drapery material 31 is being fed under the presser foot 19 from the left to the right viewing FIGS. 7 and 8. The header 31 is then placed around the depth measuring leg 7 and 8. The header 31 is then placed around the depth measuring leg 7 and then under the sewing guide leg 2 as shown in FIG. 6. The cross head is in a position where the presser foot 19 is within one of the pockets 17 or 18. As shown in FIG. 6 the first seam is formed along the edge of the sewing guide leg 2 nearer to the depth measuring leg 7. Then in the next operation the formed pleat is inserted on the spacer leg 12 and the material is pulled under the sewing guide leg 1 and over and around the depth measuring guide 7 and back again under spacer guide leg 12 and another seam is formed.

Figure 8:
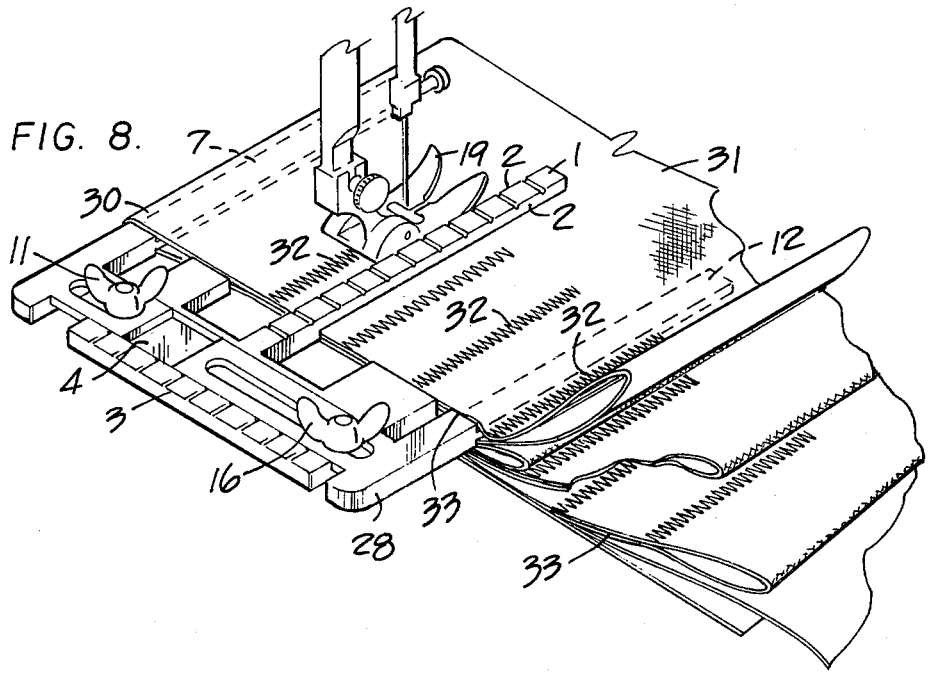
FIG. 8 is another perspective view showing the continuous forming of the pleats with double seams.

In FIG. 8 there is illustrated the forming of two seams one along each edge of the fixed sewing guide leg 1. The two seams 32 form a pocket 33, and thereafter it is optional according to design for the operator to place either the end of the pleat or the pocket 33 over the spacer leg 12 for a different or alternating pleat spacing.

Each of the adjustable legs can be quickly and easily adjusted and secured in position and a great variety of different sizes and spacings can be accomplished with very rapid adjustments.

I claim:

1. In a pleat sewing guide including a sewing guide leg, a transverse head across an end and at right angles to said sewing guide leg, a pair of adjustable legs on said transverse head spaced from from the edges of said sewing guide leg, one adjustable leg being adjusted to indicate the depth of a pleat, and the other adjustable leg being adapted to engage the next preceding pleat for spacing the pleats, and means to adjustably connect each of said pair of legs to said transverse head, the improvement of aligning projections extending from said head parallel with and spaced from the opposite edges of said guide leg forming a recess in each space selectively accommodating the presser foot of a sewing machine, aligning edges on said projections at right angles to said guide leg for guiding an edge of the material to be pleated.

2. The pleat sewing guide specified in claim 1, and aligning means on said legs including, an aligning shoulder on each the top face and the bottom face of each adjustable leg, and an aligning shoulder on the bottom face of said guide legs, said aligning shoulders being aligned with said aligning edges of said projections.

* * * * *